United States Patent [19]

Hosono et al.

[11] 4,425,373

[45] Jan. 10, 1984

[54] METHOD FOR IMAGE DEVELOPMENT BY APPLICATION OF ALTERNATING BIAS

[75] Inventors: Nagao Hosono, Chofu; Tohru Takahashi; Junichiro Kanbe, both of Tokyo; Tsutomu Toyono, Ohizumimachi; Shunji Nakamura, Kawasaki; Yasuyuki Tamura, Kawasaki, all of Japan

[73] Assignee: Canon Kabushiki Kaisha, Tokyo, Japan

[21] Appl. No.: 275,402

[22] Filed: Jun. 18, 1981

Related U.S. Application Data

[63] Continuation of Ser. No. 127,414, Mar. 5, 1980, abandoned.

[30] Foreign Application Priority Data

Mar. 8, 1979 [JP] Japan ..... 54-26902

[51] Int. Cl.[3] ..... B05D 1/04

[52] U.S. Cl. ..... 427/14.1; 118/657; 118/658

[58] Field of Search ..... 427/14.1; 118/657, 658

[56] References Cited

U.S. PATENT DOCUMENTS 4,102,305 7/1978 Schwarz ..... 118/651

*Primary Examiner*—Bernard D. Pianalto

*Attorney, Agent, or Firm*—Fitzpatrick, Cella, Harper & Scinto

[57] ABSTRACT

A method and an apparatus for developing images, wherein a moving latent image holding member is opposed to a developer carrying member with a space gap between them at a developing section in an amount greater than the thickness of a developer layer coated on the surface of the developer carrying member, and an alternating electric field is applied across the latent image holding member and the developer carrying member to cause the developer to reciprocatingly move between the developer carrying member and an image portion as well as a non-image portion on the latent image holding member at least at the closest region to the latent image holding member and the developer carrying member, thereby causing the surface of the developer layer carried on the developer carrying member to move in substantially the same direction and at substantially the same speed as the latent image surface at the developing section.

9 Claims, 16 Drawing Figures

METHOD FOR IMAGE DEVELOPMENT BY APPLICATION OF ALTERNATING BIAS

This is a continuation, of application Ser. No. 127,414, filed Mar. 5, 1980, now abandoned.

BACKGROUND OF THE INVENTION

1. Field of the Invention

This invention relates to a developing method for developing a latent image by the use of a developer and an apparatus therefor, and more particularly to a developing method using a one-component developer, especially a developing method which enables the obtaining of fogless visible images excellent in sharpness and tone reproduction, and an apparatus therefor.

2. Description of the Prior Art

Various types of developing method using a one-component developer are heretofore known such as the powder cloud method which uses toner particles in cloud condition, the contact developing method in which a uniform toner layer formed on a toner supporting member comprising a web or a sheet is brought into contact with an electrostatic image bearing surface to effect development, and the magnedry method which uses a conductive magnetic toner formed into a magnetic brush which is brought into contact with the electrostatic image bearing surface to effect development.

Among the above-described various developing methods using one-component developer, the powder cloud method, the contact developing method and the magnedry method are such that the toner contacts both the image area (the area to which the toner should adhere) and the non-image area (the background area to which the toner should not adhere) and therefore, the toner more or less adheres to the non-image area as well, thus unavoidably creating the so-called fog.

To avoid such fog, or background toner deposition there has been proposed the transfer development with space between toner donor and image bearing member in which a toner layer and an electrostatic image bearing surface are disposed in opposed relationship with a clearance therebetween in a developing process so that the toner is caused to fly to the image area by the electrostatic field thereof and the toner does not contact the non-image area. Such development is disclosed, for example, in U.S. Pat. Nos. 2,803,177; 2,758,525; 2,838,997; 2,839,400; 2,862,816 2,996,400; 3,232,190 and 3,703,157. This development is a highly effective method in preventing the fog. Nevertheless, the visible image obtained by this method generally suffers from the following disadvantages because it utilizes the flight of the toner resulting from the electric field of the electrostatic image during the development.

A first disadvantage is the problem that the sharpness of the image is reduced at the edges of the image. The state of the electric field of the electrostatic image at the edge thereof is such that if an electrically conductive member is used as the developer supporting member, the electric lines of force which emanate from the image area reach the toner supporting member so that the toner particles fly along these electric lines of force and adhere to the surface of the photosensitive medium, thus effecting development in the vicinity of the center of the image area. At the edges of the image area, however, the electric lines of force do not reach the toner supporting member due to the charge induced at the non-image area and therefore, the adherence of the flying toner particles is very unreliable and some of such toner particles barely adhere while some of the toner particles do not adhere. Thus, the resultant image is an unclear one lacking sharpness at the edges of the image area, and line images, when developed, give an impression of having become thinner than the original lines.

To avoid this in the above-described toner transfer development, the clearance between the electrostatic image bearing surface and the developer supporting member surface must be sufficiently small (e.g. smaller than 100$\mu$) and actually, accidents such as pressure contact of the developer and mixed foreign substances are liable to occur between the two surfaces. Also, maintaining such a fine clearance often involves difficulties in designing the apparatus.

A second problem is that images obtained by the above-described toner transfer development usually back toner reproducibility. In the toner transfer development, the toner does not fly until the toner overcomes the binding power to the toner supporting member by the electric field of the electrostatic image. This power which binds the toner to the toner supporting member is the resultant force of the Van der Waals force between the toner and the toner supporting member, the force of adherence among the toner particles, and the reflection force between the toner and the toner supporting member resulting from the toner being charged. Therefore, flight of the toner takes place only when the potential of the electrostatic image has become greater than a predetermined value (hereinafter referred to as the transition threshold value of the toner) and the electric field resulting therefrom has exceeded the aforementioned binding force of the toner, whereby adherence of the toner to the electrostatic image bearing surface takes place. But the binding power of the toner to the supporting member differs in value from particle to particle or by the particle diameter of the toner even if the toner has been manufactured or prepared in accordance with a predetermined prescription, and therefore, it is considered to be distributed narrowly around a substantially constant value and correspondingly, the threshold value of the electrostatic image surface potential at which the flight of toner takes place also seems to be distributed narrowly around a certain constant value. Such presence of the threshold value during the flight of the toner from the supporting member causes adherence of the toner to that part of the image area which has a surface potential exceeding such threshold value, but causes little or no toner to adhere to that part of the image area which has a surface potential lower than the threshold value, with a result that there are only provided images which lack the tone gradation having steep $\gamma$ (the gradient of the characteristic curve of the image density with respect to the electrostatic image potential).

In view of such problems, a developing device in which a pulse bias of very high frequency is introduced across an air gap to ensure movement of charged toner particles flying through the air gap, whereby the charged toner particles are made more readily available to the charged image is disclosed in U.S. Pat. Nos. 3,866,574; 3,890,929 and 3,893,418.

Such high frequency pulse bias developing device may be said to be a developing system suitable for the line copying in that a pulse bias of several KHz or higher is applied in the clearance between the toner donor member and the image retaining member to improve the vibratory characteristic of the toner and prevent the toner from reaching the non-image area in any pulse bias phase but cause the toner to transit only to the image area, thereby preventing fogging of the non-image area. However, the aforementioned U.S. Pat. No. 3,893,418 states that a very high frequency (18 KHz–22 KHz) is used for the applied pulse voltage in order to make the device suitable for the reproduction of tone gradation of the image.

U.S. Pat. No. 3,346,475 discloses a method which comprises immersing two electrodes in insulating liquid contained in a dielectrophoretic cell and applying thereto an AC voltage of very low frequency (lower than about 6 Hz) to thereby effect the development of a pattern corresponding to the conductivity variance.

Further, U.S. Pat. No. 4,014,291 discloses a method in which dry, one component magnetic toner on the non-magnetic, non-conductive transfer cylinder which encloses a rotating cylindrical magnet is transferred to the deposit zone to develop an electrostatic latent image on coated paper, but this patent does not suggest that a bias is applied for the above-described purpose.

A further advance method of the image development is described in the pending U.S. patent applications Ser. No. 58,434, the continuation of which matured into U.S. Pat. No. 4,395,476 on July 26, 1983 and Ser. No. 58,435, now U.S. Pat. No. 4,292,387, issued Sept. 29, 1981 of the same assignee-to-be as that of the present application.

In U.S. Pat. No. 3,232,190 and others, for example, a web which carries thereon a toner layer is moved in the opposite direction as that of the photosensitive drum at the developing section. However, when the toner layer is moved at a high relative speed with respect to the electrostatic image such that the toner layer and the electrostatic image are moved in mutually opposite directions as mentioned above, there occurs directivity in the distribution of the toner quantity to be adhered onto the image portion on the surface of the electrostatic image holding member.

SUMMARY OF THE INVENTION

It is therefore an object of the present invention to provide a method and an apparatus for developing images which enables a sharp visible image of high quality to be obtained by the use of a developer not containing carrier particles having a particle diameter greater than the so-called "toner particles". The image to be obtained by this method and apparatus is transferable on plain paper, rich in its image gradation and reproducibility, and excellent in its reproducibility at the edge portion of the image without a line image being developed extremely thinner than its image original and without occurrence of directivity in the distribution of the toner quantity to be adhered onto the image portion on the surface of the latent image holding member.

It is another object of the present invention to provide a method and an apparatus, in which the developer carrying member having a magnet incorporated therein and bearing a layer of magnetic developer on its surface is disposed in confrontation to the latent image holding member with a predetermined space gap between them at the developing section, an alternating electric field is applied to the space gap for image development to cause the developer particles to move reciprocatingly, and a magnetic field having a different magnetic flux density, but being the same in the magnetic field direction is selectively formed.

It is still another object of the present invention to provide a method and an apparatus for image development capable of obtaining a developed image of good image quality having excellent image gradation and being substantially free from ground fogging. Such excellent results can be realized by adjusting the magnetic field intensity to be formed at the developing section in accordance with improvement in gradation of the developed image due to the abovementioned alternating electric field as well as the kind of image original to be reproduced (such as colored paper which is liable to cause ground fogging, and photographs containing intermediate tone images), thereby controlling the threshold value for transition of the developer to be energized by the alternating electric field.

It is yet another object of the present invention to provide a method and an apparatus for developing images, in which a moving latent image holding member is opposed to a developer carrying member with a space gap between them at a developing section in an amount greater than thickness of a developer layer coated on the surface of the developer carrying member, and an alternating electric field is applied across the latent image holding member and the developer carrying member to cause the developer to perform reciprocating movement between the developer carrying member and an image portion as well as a non-image portion on the latent image holding member at least at the closest region to the latent image holding member and the developer carrying member, thereby causing the surface of the developer layer carried on the developer carrying member to move in substantially the same direction and at substantially the same speed as the latent image surface at the developing section.

It is another object of the present invention to provide a method and an apparatus, in which the image development is done by oppositely providing the developer carrying member and the latent image holding member with a small space gap between them at the image developing section, an alternating bias being applied to the space gap for the development, and selectively utilizing the clouding function, wherein repulsive magnetic fields are interposed at the developing section, and the magnetic brushing function, wherein a single magnetic field is interposed at the developing section, so that they may be selectively changed over in accordance with the image original.

By the change-over operation between the clouding function and the magnetic brushing function, there accrues such an effect that a developed image which is excellent in its image gradation and free from the ground fogging can be obtained by causing the alternating electric field and the repulsive magnetic field to carry out the development to emphasize the edge portion when the line image such as the so-called "line copy" is to be reproduced, and by cooperatively employing the magnetic field function due to the single magnet pole and the alternating electric field function. Other objects and features of the present invention will become apparent from the following description of some embodiments of the invention taken in conjunction with the accompanying drawings.

DESCRIPTION OF THE PREFERRED EMBODIMENTS

The principle of the toner transfer development with an electrical bias of the present invention will be described by reference to FIG. 1. In the lower portion of FIG. 1, there is shown a voltage wavefrom applied to a toner carrier. It is shown as a rectangular wave, whereas it is not restricted thereto. A bias voltage of the negative polarity having a magnitude of $V_{min}$ is applied at a time interval $t_1$, and a bias voltage of the positive polarity having a magnitude of $V_{max}$ is applied at a time interval $t_2$. When the image area charge formed on the image surface is positive and this is developed by negatively charged toner, the magnitudes of $V_{min}$ and $V_{max}$ are selected so as to satisfy the relation that $$V_{min}<V_L<V_D<V_{max} \quad (1)$$

where $V_D$ is the image area potential and $V_L$ is the non-image area potential. If so selected, at the time interval $t_1$, the bias voltage $V_{min}$ acts to impart a bias field with a tendency to expedite the contact of toner with the image area and non-image area of an electrostatic latent image bearing member and this is called the toner transition stage. At the time interval $t_2$, the bias voltage $V_{max}$ acts to impart a bias field with a tendency to cause the toner which as transited to the latent image bearing surface in the time interval $t_1$ to be returned to the toner carrier and this is called the back transition stage.

Figure 1:
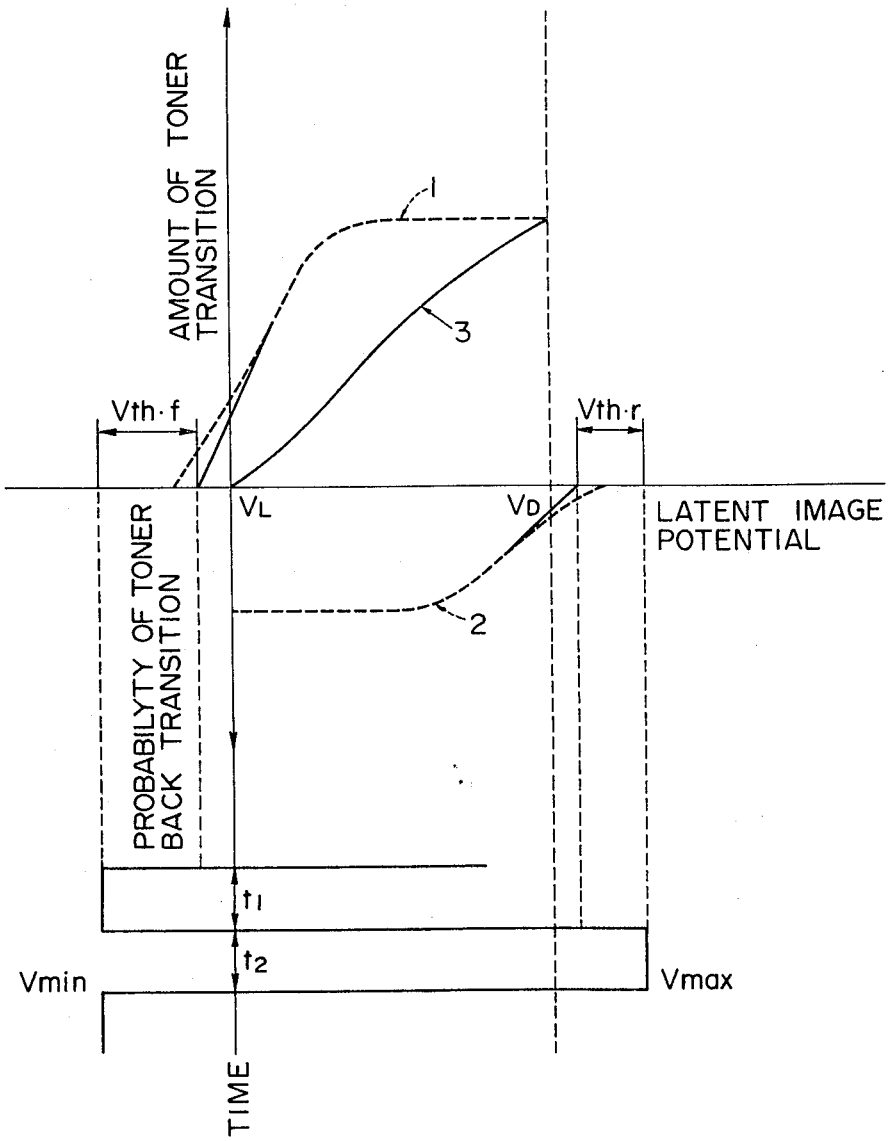
FIG. 1 illustrates the amount of transition of the toner and the characteristics of the degree of toner back transition for the potential of a latent image, as well as an example of the voltage waveform applied.

Vth·f and Vth·r in FIG. 1 are the potential threshold values at which the toner transits from the toner carrier to the latent image surface or from the latent image surface to the toner carrier, and may be considered potential values extrapolated by a straight line from the points of the greatest gradient of the curves shown in the drawing. In the upper portion of FIG. 1, the amount of toner transition at $t_1$ and the degree of toner back transition at $t_2$ are plotted with respect to the latent image potential.

The amount of toner transition from the toner carrier to the electrostatic image bearing member in the toner transition stage is such as curve 1 shown by broken line in FIG. 1. The gradient of this curve is substantially equal to the gradient of the curve when no bias alternate voltage is applied. This gradient is great and the amount of the toner transition tends to be saturated at a value intermediate $V_L$ and $V_D$ and accordingly, it is not suited for reproduction of half-tone images and provides poor tone gradation. Curve 2 indicated by another broken line in FIG. 1 represents the probability of toner back transition.

In the developing method utilized in the present invention, an alternating electric field is imparted so that such toner transition stage and toner back transition stage may be alternately repeated and in the bias phase $t_1$ of the toner transition stage of that alternating electric field, toner is positively caused to temporally reach the non-image area of the electrostatic latent image bearing member from the toner carrier (of course, toner is also caused to reach the image area) and toner is sufficiently deposited also on the half-tone potential portion having a low potential approximate to the light region potential $V_L$, whereafter in the bias phase $t_2$ of the toner back transition stage, the bias is caused to act in the direction opposite to the direction of toner transition to cause the toner which has also reached the non-image portion as described to be returned to the toner carrier side. In this toner back transition stage, as will later be described, the non-image area does not substantially have the image potential originally and therefore, when a bias field of the opposite polarity is applied, the toner which has reached the non-image area as described tends to immediately leave the non-image area and return to the toner carrier. On the other hand, the toner once deposited on the image area including the half-tone area is attracted by the image area charge and therefore, even if the opposite bias is applied in the direction opposite to this attracting force as described, the amount of toner which actually leaves the image area and returns to the toner carrier side is small. By so alternating the bias fields of different polarities at a preferred amplitude and frequency, the above-described transition and back transition of the toner are repeated a number of times at the developing station. Thus, the amount of toner transition to the latent image surface may be rendered to an amount of transition faithful to the potential of the electrostatic image. That is, there may be provided a developing action which may result in a variation in amount of toner transition having a small gradient and substantially uniform from $V_L$ to $V_D$ as shown by curve 3 in FIG. 1. Accordingly, practically no toner adheres to the non-image area while, on the other hand, the adherence of the toner to the half-tone image areas takes place corresponding to the surface potential thereof, with a result that there is provided an excellent visible image having a very good tone reproduction. This tendency may be made more pronounced by setting the clearance between the electrostatic latent image bearing member and the toner carrier so that it is greater toward the termination of the developing process and by decreasing and converging the intensity of the above-mentioned electric field in the developing clearance.

Figure 2A:
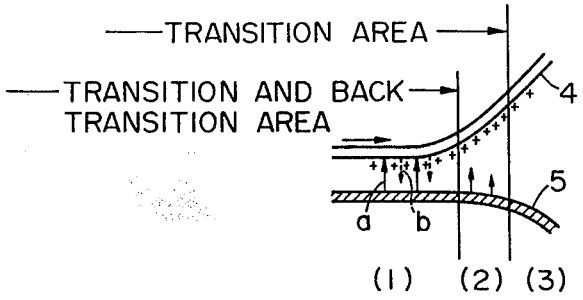
FIGS. 2A and 2B illustrate the process of the developing method utilized in the present invention.
Figure 2B:
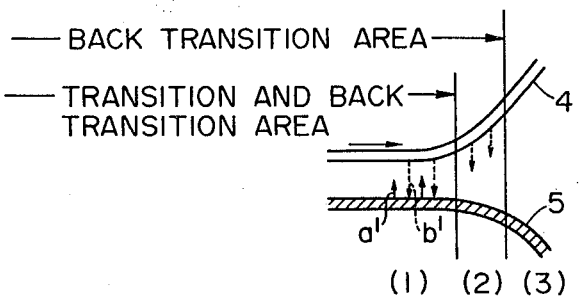
Figure 2C:
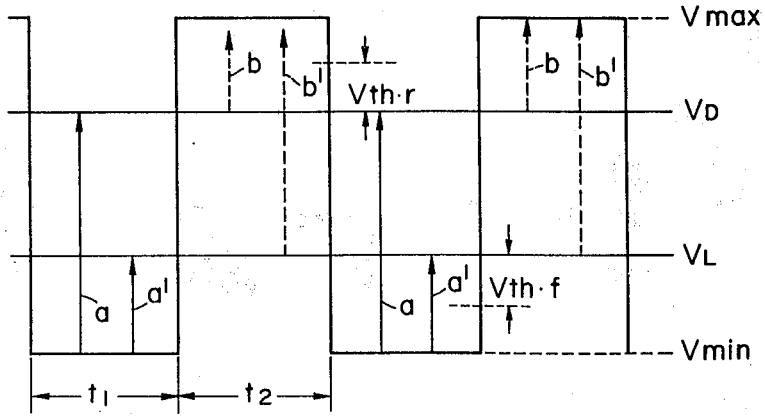
FIG. 2C shows an example of the applied voltage waveform.

An example of such developing process utilized in the present invention is shown in FIGS. 2A and 2B. As shown in FIGS. 2A and 2B, the electrostatic image bearing member 4 is moved in the direction of arrow through developing regions (1) and (2) to a region (3). Designated by 5 is a toner carrier. Thus, the electrostatic image bearing surface and the toner carrier gradually widen the clearance therebetween from their most proximate position in the developing station. FIG. 2A shows the image area of the electrostatic image bearing member and FIG. 2B shows the non-image area thereof. The direction of arrows shows the direction of the electric fields and the length of the arrows indicates the intensity of the electric fields. It is important that the electric fields for the transition and back transition of the toner from the toner carrier are present also in the non-image area. FIG. 2C shows a rectangular wave which is an example of the waveform of the alternate current applied to the toner carrier, and schematically depicts, by arrows in the rectangular wave, the relation between the direction and intensity of the toner transition and back transition fields. The shown example refers to the case where the electrostatic image charge is positive, whereas the invention is not restricted to such case. When the electrostatic image charge is positive, the relations between the image area potential $V_D$, the non-image area potential $V_L$ and the applied voltages $V_{max}$ and $V_{min}$ are set as follows:

$$\left.\begin{array}{l} |V_{max} - V_L| > |V_L - V_{min}| \\ |V_{max} - V_D| < |V_D - V_{min}| \end{array}\right\} \quad (2)$$

In FIGS. 2A and 2B, a first process in the development occurs in the region (1) and a second process occurs in the region (2). In the case of the image area shown in FIG. 2A, in the region (1), both of the toner transition field a and the toner back transition field b are alternately applied correspondingly to the phase of the alternate field and the transition and back transition of the toner result therefrom. As the developing clearance becomes greater, the transition and back transition fields become weaker and the toner transition is possible in the region (2) while the back transition field sufficient to cause the back transition (below the threshold value |Vth.r|) becomes null. In the region (3), the transition neither takes place any longer and the development is finished.

In the case of the non-image area shown in FIG. 2B, in the region (1), both the toner transition field a' and the toner back transition field b' are alternately applied to create the transition and back transition of the toner. Thus, fog or background deposition is created in this region (1). As the clearance is wider, the transition and the back transition field become weaker and when the region (2) is entered, the toner back transition is possible while the transition field sufficient to cause transition (below the treshold value) becomes null. Thus, in this region, fog is not substantially created and the fog created in the region (1) is also sufficiently removed in this stage. In the region (3), the back transition neither takes place any longer and the development is finished. As regards the halftone image area, the amount of toner transition to the final latent image surface is determined by the magnitudes of the amount of toner transition and the amount of toner back transition corresponding to that potential, and after all, there is provided a visible image having a small gradient of curve between the potentials $V_L$ to $V_D'$ as shown by curve 3 in FIG. 1, and accordingly having a good tone gradation.

In this manner the toner is caused to fly over the developing clearance and is caused to temporarily reach the non-image area as well to improve the tone gradation, and in order that the toner havng reached the non-image area may be chiefly stripped off toward the toner carrier, it is necessary to properly select the amplitude and alternating frequency of the alternate bias voltage applied. Results of the experiment in which the effect of the present invention has clearly appeared by such selection will be described further.

Such application of the alternate bias, of lower frequency brings about remarkable enhancement of the tone gradation, but the voltage value thereof must be properly set. That is, too great a value for the $|V_{min}|$ of the alternate bias may result in an excessive amount of toner adhering to the non-image area during the toner transition stage and this may prevent sufficient removal of such toner in the developing process, which in turn may lead to fog or stain created in the image. Also, too great a value for $|V_{max}|$ would cause a great amount of toner to be returned from the image area, thus reducing the density of the so-called solid black portion. To prevent these phenomena and to sufficiently enhance the tone gradation, $V_{max}$ and $V_{min}$ may preferably and reasonably be selected to the following degrees:

$$V_{max} \approx V_D + |\mathrm{Vth{\cdot}r}| \quad (3)$$

$$V_{min} \approx V_L + |\mathrm{Vth{\cdot}f}| \quad (4)$$

Vth·f and Vth·r are the potential threshold values already described. If the voltage values of the alternate bias are so selected, the excess amount of toner adhering to the non-image area in the toner transition stage and the excessive amount of toner returned from the image area in the back transition stage would be prevented to ensure obtainment of proper development.

The foregoing description has been made with respect to the case where the image area potential VD is positive, whereas the present invention is not restricted thereto but it is also applicable to a case where the image area potential is negative and in this latter case, if the positive of the potential is small and the negative of the potential is great, the present invention is equally applicable. Therefore, when such image area charge is negative, the aforementioned formulas (1)–(4) are represented as the following formulas (1')–(4').

$$V_{max} > V_L > V_D > V\,\mathrm{min} \quad (1')$$

$$\left.\begin{array}{l} |V_{min} - V_L| > |V_L - V_{max}| \\ |V_{min} - V_D| < |V_L - V_{max}| \end{array}\right\} \quad (2')$$

$$V_{min} \approx V_D - |\mathrm{Vth{\cdot}r}| \quad (3')$$

$$V_{max} \approx V_L + |\mathrm{Vth{\cdot}f}| \quad (4')$$

In the following, preferred embodiments and preferred modes of operations according to the present invention will be described in reference to the accompanying drawings.

EXAMPLE 1

Figure 3A:
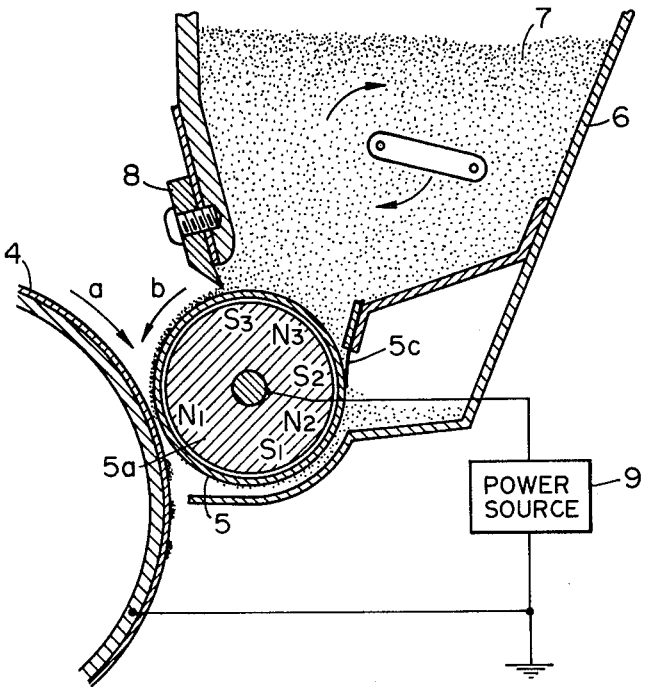
FIG. 3A is a schematic cross-sectional view of one embodiment of the developing apparatus according to the present invention.
Figure 3B:
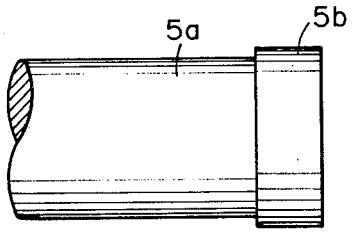
FIG. 3B is a front view, in part, of a developing sleeve used in the developing apparatus shown in FIG. 3A.

FIG. 3A schematically shows one embodiment of the present invention, in which a reference numeral 4 designates a latent image holding member, on which an electrostatic latent image is formed by the known electrophotographic process (such as Carlson process; electrophotographic processes as described in U.S. Pat. Nos. 3,666,363, No. 4,071,361, and so forth; and other processes). The latent image on this latent image holding member 4 is then developed by a thin magnetic developer layer coated on the surface of a developer carrying member 5 made of a non-magnetic material in sleeve form. In configuration to the image developing section of this latent image holding member 4, there are disposed, on the rear surface of the developing sleeve, magnet poles $N_1$ of a permanent magnet 5*a* (having a magnetic flux density of 650 gausses on the surface of the developing sleeve). A space gap between the latent image holding member 4 and the developing sleeve 5 is maintained at approximately 300 microns by causing a roll 5*b* coaxial with the shaft of the developing sleeve 5 to contact the peripheral surface of the latent image holding member 4 as shown in FIG. 3B. The developing sleeve 5 is so designed that it may rotate independently of the roll 5*b*. A reference numeral 6 designates a hopper, in which a developing agent 7 (in this embodiment, an electrically insulative magnetic developer composed of toner particles and magnetic powder. A numeral 8 refers to a developer layer thickness regulating member to control the thickness of the developer coated on the developing sleeve 5, the regulating member being in the form of a blade made of a magnetic material. In confrontation to this magnetic blade 8, there is disposed a magnet pole $S_3$ of the permanent magnet on the rear surface of the developing sleeve 5 to regulate thickness of the developer layer to a thickness of approximately 120 microns, thereby coating the developer on the developing sleeve 5. The developer 7 is charged mainly between the magnetic blade 8 and the developing sleeve 5 so that it may be negatively charged. A numeral 9 refers to a power source for applying an alternating electric field across the latent image holding member 4 and the developing sleeve 5. A reference numeral 5*e* designates a scraper for removing the residual developer from the developing sleeve 5. The electrostatic latent image on the latent image holding member 4 has a surface potential of +500 V at the dark portion, and zero volt at the bright portion. The bias voltage applied from the power source 9 is an alternating voltage having a frequency of 200 Hz and a peak voltage of 800 V pp superposed on a d.c. voltage of +200 V. The magnetic field intensity on the surface of the developing sleeve 5 of the magnet pole $S_3$ disposed within the developing sleeve 5 in confrontation to the magnetic blade 8 is 650 gausses. The space gap between the developing sleeve 5 and the magnetic blade 8 is set at 250 microns. Further, the latent image holding member 4 is rotated in the direction of an arrow a at a peripheral speed of 110 mm/sec. for the image formation and development.

When the developing sleeve 2 itself is rotated at the peripheral speed of 110 mm/sec., and in the direction of an arrow b, it is found out that directivity has occurred in the distribution of the toner quantity adhered onto the image portion in a web shaped pattern on the latent image holding member 4 parallel to the shaft of the developing sleeve 5. This does not mean that favorable edging effect appears at the end part parallel to the shaft of the developing sleeve 5 in the web-shaped pattern, but it means that end part of the web-shaped pattern opposite to the rotational direction of the latent image holding member 4 has a larger toner quantity than at the other end part thereof, hence difficulty exists in the image reproduction at the end portion thereof.

Next, the peripheral speed of the developing sleeve 5 is increased to 120 mm/sec. for the development. It has been found out that, in this case, the toner quantity at one end portion of the web-shaped pattern opposite to the rotational direction of the latent image holding member 4 becomes much larger than that at the other end portion in comparison with the previous case. In this consequence, the end portion of the web-shaped pattern to the side of the rotational direction of the latent image holding member 4 becomes obscure and sharpness in the developed image tends to be lost.

When the peripheral speed of the developing sleeve 5 is decreased to approximately 106 mm/sec. for the development, the directivity in the distribution of the toner quantity adhered onto the image portion of the web-shaped pattern formed in the abovementioned two cases has been extinguished, and favorable visible image having appropriate edging effect can be obtained.

Figure 4:
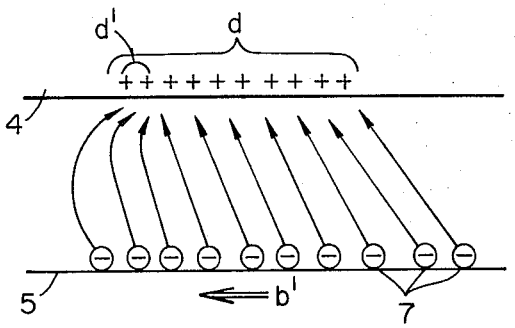
FIG. 4 is an explanatory diagram to indicate the problem of directivity in the image developing function.

Considering one interpretation to what is meant by the foregoing experiments. It is assumed that the relative speed between the latent image holding member 4 and the developer carrying member 5 differs at the developing section, and the developer carrying member 5 moves in the direction of an arrow b' with respect to the latent image holding member 4 as shown in FIG. 4. In this case, the developer 7, while moving in the direction of the arrow b' moves toward the latent image holding member 4 at the developing section as shown in FIG. 4 due to the electrostatic field by the image portion d of the electrostatic latent image on the latent image holding member 4 and the alternating electric field applied from outside to the latent image holding member 4 and the developer carrying member 5, whereby it is adhered onto the image portion for the development. In this case, the alternating field intensity applied is not so strong as to neglect the field intensity due to the electrostatic latent image on the latent image holding member 4, hence the developer 7 when it flies from the developer carrying member 5 moves in the direction of the relative movement (i.e., in the direction of the arrow b') of the developer carrying member 5, as viewed from the latent image holding member 4, for development. On account of this, it is understood that the directivity occurs in the moving direction of the developing sleeve 5 in the direction of the toner adhering quantity at the end portion d' of the image. It is however necessary that a difference in the supply quantity of the developer in the image portion due to difference in the peripheral speed of the developing sleeve 5 be taken into consideration. This situation is shown, for example, in FIGS. 5A and 5B, wherein one example of the cause for occurrence of the directivity in the distribution of the toner quantity at the end portion of the image, which takes place when the peripheral speed of the developing sleeve 5 is relatively slower than the peripheral speed of the latent image holding member 4.

Figure 5A:
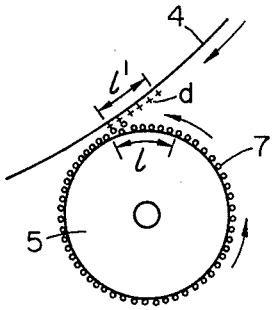
FIGS. 5A and 5B are respectively explanatory diagrams to explain difference in the supply quantity of the developer due to difference in the peripheral speed of the developer carrying member.
Figure 5B:
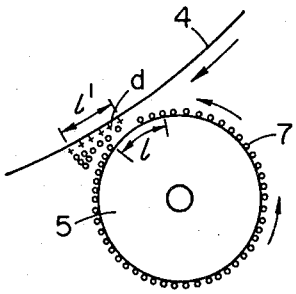

FIG. 5A indicates a process, in which the image portin d of the electrostatic latent image on the latent image holding member 4 rotates to be closer to the developing sleeve 5 and enter into the developing section. FIG. 5B indicates a process, in which the image portion d further rotates to be away from the developing sleeve 5 and the developing section, thereby terminating the image development. In this situation, a circumferential length of the developing sleeve 5 of the image portion d is shown by a reference letter l, and a length of the latent image holding member surface corresponding to this circumferential length is indicated by a letter l'. When the peripheral speed of the developing sleeve 5 is slower than that of the latent image holding member 4, the developer quantity is larger at the tip end of the image portion d than at the rear end thereof due to shortage in the feeding quantity of the developer 7 coated on the developer sleeve 5 by its rotation to the developing section, as shown in FIG. 5B, hence non-uniformity in the toner quantity distribution takes place. In the case of the image development shown in FIGS. 5A and 5B, therefore, the peripheral speed of the latent image holding member 4 and that of the developer carrying member 5 may be made equal.

Figure 6:
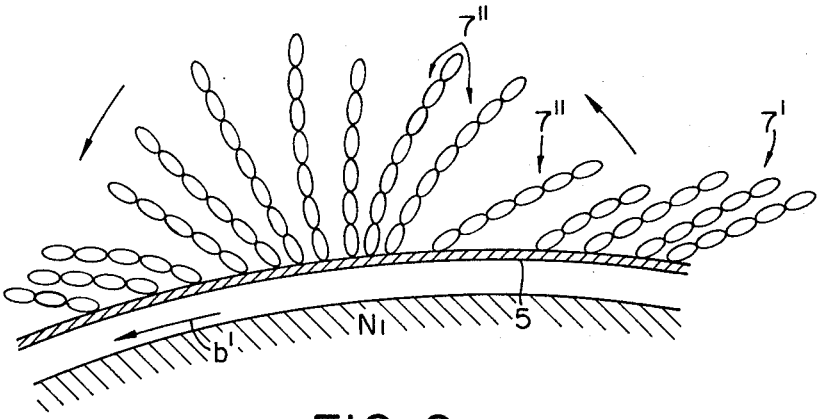
FIG. 6 is an explanatory diagram to explain the movement of the developer particles due to the magnetic field.

However, in the case of the FIG. 3A embodiment where the magnet poles are provided within the developing sleeve in confrontation to the developing section, the situation will become more complicated. This is shown diagrammatically in FIG. 6. In the illustration, when the developing sleeve 5 rotates in the direction of an arrow b', ears of the magnetic developer on the sleeve are fallen down as indicated by a numeral 7' at a position away from the developing magnet pole $N_1$. As they are closer to the magnet pole $N_1$, the ears gradually stand up as indicated by a reference numeral 7''. Further rotation of the developing sleeve 5 causes the ears to fall down again as they become away from the developing section. In order to eliminate the relative speed on the toner surface layer with respect to the electrostatic latent image due to the standing and falling movement of the toner brush, the peripheral speed of the developer carrying member 7 in the arrow direction (the moving direction of the latent image) may be made slightly slower than the peripheral speed of the latent image holding member 4. As the result of experiments, it has been found out that, when the image development is effected by using a toner having an average particle diameter of approximately 10 microns and prepared by mixing 30 parts of magnetite, approx. 60 parts of polystyrene, 3 parts of a charge control agent, and 6 parts of carbon, and maintaining the peripheral speed of the latent image holding member at 110 mm/sec. and that of the developing sleeve at 106 mm/sec., there can be obtained a visible image of high quality having image sharpness and being free from directivity at the end portion of the image. In this case, the peripheral speed of the developing sleeve may be made slower by approximately 2 to 6% than the peripheral speed of the latent image holding member.

The prevention of the directivity characteristic in the developed image with movement of the toner particles as mentioned above exhibits a particularly remarkable effect in the present invention where the alternating bias electric field is applied to the developing section to accelerate reciprocating motion of the toner particles. Therefore, in the following, explanations will be given as to the function and effect of the alternating bias application in conjunction with the fact that there is an appropriate range for this bias alternating frequency in view of the toner movement.

Figure 7A:
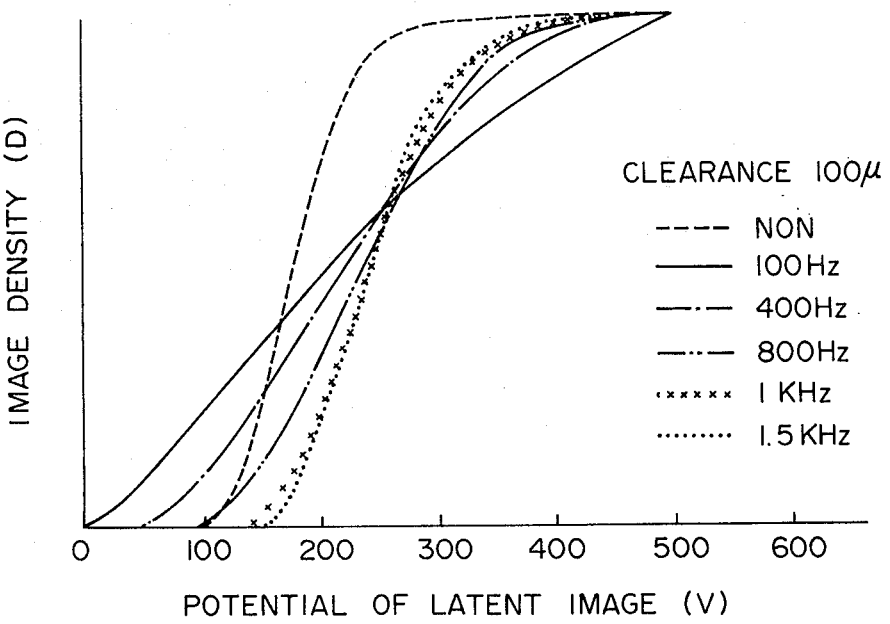
FIGS. 7A and 7B are respectively graphical representations showing characteristic curves which indicate the changing state of the relationship between the latent image potential and the image density due to frequency of the alternating bias.
Figure 7B:
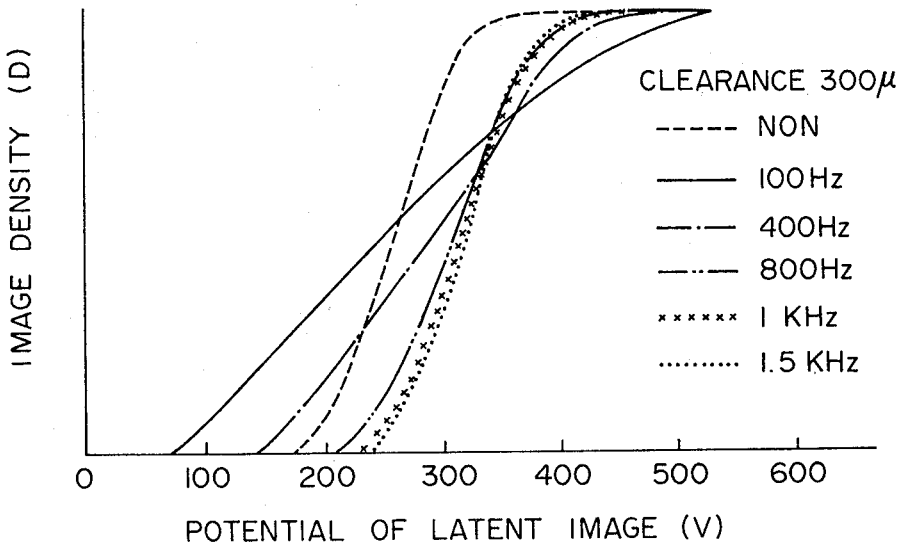

FIGS. 7A and 7B are respectively graphical representations showing the characteristics of the image reflection density (D) to the electrostatic latent image potential (V). The experimental results using the apparatus shown in FIG. 3A are plotted on the graph. In the following explanations, the curves are called "V-D curves". The experiments have been done in the following manner. A positive electrostatically charged latent image is formed on the cylindrical electrostatic image forming surface shown in FIG. 3A. For the toner, the abovementioned magnetic toner (containing 30 parts of magnetite) is used. The toner is coated on the surface of the developing sleeve to a layer thickness of approximately 120 microns or so, and is negatively charged by friction between the toner and the sleeve surface. FIG. 7A shows the experimental results when the minimum space gap for development between the electrostatic image forming surface and the magnetic sleeve is maintained at 100 microns, while FIG. 7B shows the experimental results when it is maintained at 300 microns. The magnetic flux density at the developing section due to the magnet provided inside the sleeve is approximately 650 gausses. The peripheral speed of the cylindrical electrostatic image forming surface is 110 mm/sec., and that of the developing sleeve is 106 mm/sec. Accordingly, the electrostatic image forming surface becomes gradually away from the toner holding member after its passage through the minimum space gap at the developing section. The alternating electric field to be applied to this developing sleeve is in a sinusoidal waveform having an amplitude of 400 V (peak-to-peak 800 V), on which a d.c. voltage of +200 V is superposed. FIGS. 7A and 7B respectively show the V-D curves with the alternating frequencies of the applied voltage being 100 Hz, 400 Hz, 800 Hz, 1 KHz, and 1.5 KHz, and the V-D curve with no external field being applied and the rear surface electrode of the electrostatic image forming surface and the developing sleeve being rendered conductive.

From these experimental results, it will be understood that, when no external field is applied the inclination of the V-D curve, i.e., a value r, is very great, but, this value r becomes reduced by application of an alternating field of a low frequency, whereby the gradation in the image becomes extremely high. When the frequency of the external field increases, the value r becomes gradually large, and the effect of increasing the image gradation becomes less. This effect becomes extremely weak when the space gap is 100 microns and the frequency exceeds 1.5 KHz. When the space gap is 300 microns and the frequency is 800 Hz or so, the effect becomes reduced, and when it exceeds 1.5 KHz, the effect becomes extremely weak. The cause for this phenomenon is considered to be as follows. When the toner repeats adhesion and separation between the surfaces of the developing sleeve and the latent image forming member in the course of the image development with the alternating field being applied, a finite time is required for the toner to perform the reciprocating movement without failure. In particular, the toner which is transferred under a weak field necessitates a long period of time to surely perform the transfer. On the other hand, for a density of an intermediate gradation to be reproduced, it is necessary that the toner which has been subjected to a field of a certain threshold value and above, though it may be a weak wave, be surely transferred within a half period of the alternating electride field. For this purpose, the alternating field should preferably have a lower frequency. Therefore, particularly favorable image gradation can be obtained with the alternating field of a lower frequency as represented by the experimental results. Adequacy of this discussion can be obtained from comparison of both experimental results in FIGS. 7A and 7B. The experimental results shown in FIG. 7B have been obtained under the same conditions as those in the experiment in FIG. 7A with the exception that the space gap between the electrostatic image forming surface and the sleeve surface is made as large as 300 microns. When the space gap is widened, the field intensity which the toner receives becomes small, hence the transfer speed of the toner becomes small accordingly. Further, since the flying distance becomes longer, the transfer time becomes also longer. As is apparent from FIG. 7B, the value r becomes considerably large at the frequency of 800 Hz or so, in reality. When the frequency exceeds 1.5 KHz, the value r becomes substantially equal to that in the case of the alternating voltage not being applied substantially. Consequently, with a view to producing the same effect as in the case of the narrow space gap as to improvement in the image gradation, it is preferable that either the frequency be lowered, or intensity of the alternating voltage be increased.

On the other hand, when the frequency is too low, the reciprocating motion of the toner is not repeated sufficiency during passage of the latent image forming surface through the developing section with the consequence that developing irregularity tends to occur on the image due to the alternating voltage. According to the above-mentioned experimental results, a substantially favorable image can be obtained with the frequency of upto and including 40 Hz, while irregularity occurs in the developed image when the frequency becomes lower than 40 Hz. It has been found that the lower limit of the frequency not to cause such irregularity in the developed image depends particularly on the developing conditions, above all, a developing speed (or process speed) Vp mm/sec. According to the experiments, since the moving speed of the electrostatic image forming surface is 110 mm/sec., the lower limit of the frequency becomes $40/110 \times Vp \approx 0.3 \times Vp$. It has also been verified that the waveform of the alternating voltage to be applied may be regular waveform, rectangular waveform, saw-tooth waveform, or asymmetrical waveform of these waveforms, any of which is effective.

Thus, application of the alternating bias brings a remarkable effect in the improvement of the image gradation. Although explanations have heretofore been made with respect to electrostatic latent image, a favorable visible image can be obtained even in the development of a magnetic latent image, when a magnetic toner containing therein magnetic power is used as the developer. In this case, however, a developing roller comprising a developing sleeve having no magnet pole should be used at the developing section and in its vicinity.

As is apparent from the foregoing explanations, the method and the apparatus according to the present invention are capable of avoiding directivity to occur in the distribution of the developer quantity to be adhered onto the image portion, when the moving latent image holding member and the developer carrying member are spaced apart at the developing section in an amount greater than the thickness of the developer layer coated on the surface of the developer carrying member, and an alternating electric field is applied across the latent image holding member and the developer carrying member for the image development. Accordingly, there can be obtained a high quality developed image having sharpness in contour and being faithful to the original, in addition to those effects of preventing the ground fogging and improvement in the image gradation due to application of the alternating bias.

EXAMPLE 2

On one hand, there can be effected the image development to high image gradation as mentioned in the preceding Example 1. On the other hand, there tends to readily occur undesirable fogging on the developed image when the original image has a colored ground such as news paper, diazo paper, and others.

Therefore, this example is directed to prevent directivity in the distribution of the developer from taking place as in the previous example, and to remove such inconvenience by controlling the abovementioned threshold value Vth·f for the toner transfer. The transfer threshold value of the toner is governed by the restraining force of the toner to the holding member, and the present invention is to control this restraining force of the magnetic toner to the holding member by the magnetic field intensity at the developing section.

Figure 8:
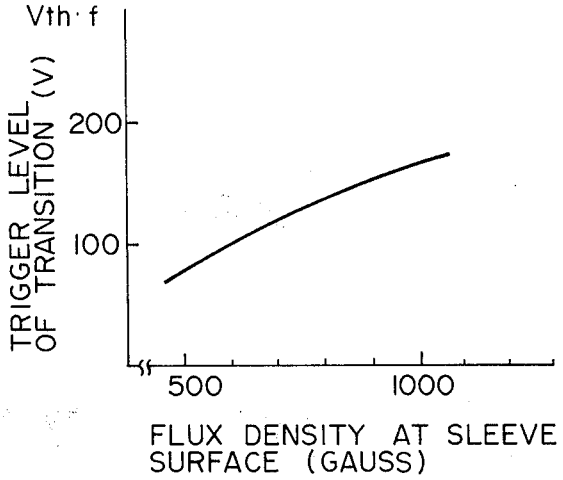
FIG. 8 is also a graphical representation showing a characteristic curve which indicates the relationship between the magnetic flux density on the developing sleeve surface and the threshold value for transfer of the developer.

FIG. 8 shows the toner transfer threshold value due to the surface magnetic flux on the developing sleeve. By increasing the surface magnetic flux density on the developing sleeve, the transfer threshold value of the toner can be increased. This depends on the characteristics (e.g., content of the magnetic material, frictional charge quantity of the toner, toner particle diameter, specific gravity of the toner, etc.) of the magnetic toner.

Figure 9:
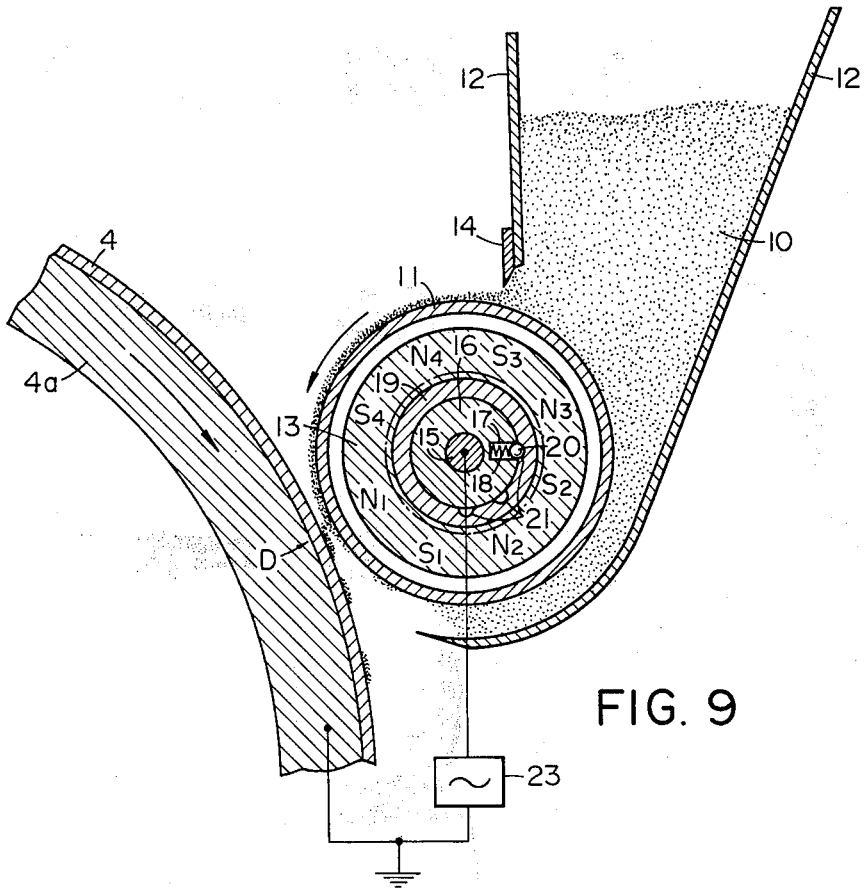
FIG. 9 is a schematic cross-sectional view of one embodiment of the developing apparatus according to the present invention.

FIG. 9 is a schematic cross-sectional view of the second embodiment of the developing apparatus according to the present invention. In the drawing, a reference numeral 11 designates a non-magnetic cylinder made of aluminum, etc. which is so disposed that it may have a small space gap with the photosensitive member 4 at the developing section D (where the developer is electrostatically adhered onto the electrostatic image portion on the photosensitive member 4). Onto the peripheral surface of this cylinder 11, there is supplied one-component insulative magnetic developer (magnetic toner) 10 from a non-magnetic vessel 12. The developer 10 is held on the peripheral surface of the non-magnetic cylinder 11 by a multi-polar magnet member 13, and conveyed to the developing section D by the rotation of the cylinder 11 in the arrowed direction by a motor (not shown). In this instance, the sleeve 11 is driven in such a manner that the developer 10 on the sleeve may be moved at a substantially same speed and in the same direction as those of the latent image surface. During the conveyance, since the developer particles in the developer layer repeat the standing-up and falling-down in the form of a chain of ears by the action of the magnetic field formed on the magnet member 13 to cause friction between the peripheral surface of the electrically conductive cylinder 11 and the developer particles, the frictional charging system of each and every member is so selected that the developer particles are frictionally charged in the polarity opposite that of the electrostatic image portion. A numeral 14 refers to a doctor blade made of a magnetic material, which is fixed on the front wall 12' of the non-magnetic vessel 12, and maintained with a small space gap with the peripheral surface of the cylindrical member 11. By this small space gap, the quantity (or layer thickness) of the developer carried on the peripheral surface of the cylinder 11 for conveyance to the developing section is controlled. In order to reduce thickness of the developer layer, the magnetic blade 14 is opposed to one of the magnet poles (in the illustration, the magnet pole $S_3$) of the multipolar magnet member through the cylindrical wall of the cylinder 11. In order words, the magnetic blade 14 cooperates with the magnet pole to form a magnetic field curtain (this should preferably be substantially perpendicular to the peripheral surface of the cylinder 11) between the cylinder 11 and the blade 14, thereby regulating the quantity of the developer passing therethrough.

The thin developer layer formed on the peripheral surface of the cylinder 11 reaches the developing section D in accordance with rotation of the cylinder 11. At the developing section, there is formed a magnetic field by the magnet pole (in the illustration, $N_1$) of the magnet member 13. This magnetic field is perpendicular to the peripheral surfaces of both photosensitive member 4 and the cylinder 11 in the mainimum space gap at the developing section between the cylinder 11 and the photosensitive member 4 (the photosensitive drum including the photosensitive member 4 being non-magnetic), i.e., in the space gap between the photosensitive member 4 and the cylinder 11 on the line component joining the rotational centers of both photosensitive drum 4 and cylinder 11. In other words, one magnet pole is positioned on the above-mentioned line component, whereby movement and adherence of the developer particles to the photosensitive member can be effected extremely satisfactorily. While the direction of the above-mentioned magnetic field may not be perpendicular to the peripheral surface of both photosensitive member 4 and cylinder 11 at the minimum space gap, it is preferable that at least one of the magnet poles of the magnet member be disposed at the rear position of the developing section D with respect to the cylindrical wall thickness of the the cylinder 11. In any case, the magnetic developer layer on the peripheral surface of the cylinder 11 at the developing section D increases its thickness by the action of the abovementioned magnetic field in comparison with a case where no magnetic field is present, or where the magnetic field is in parallel with the peripheral surface of the cylinder 11 as in the region between one magnet pole and the other arranged side by side, whereby the surface part of the developer layer becomes closer to the surface of the photosensitive member 4.

A power source 23 is provided between the developer carrying cylindrical member 11 and the rear electrode 4*a* of the photosensitive member 4 to enable the alternating field to be applied, and the toner particles reciprocatingly move in the space gap between the surface of the photosensitive member 4 and the cylindrical member 11 at the developing section, whereby a developed image free from the fogging and having high image gradation is obtained. The developer which remains on the peripheral surface of the cylindrical member 11 without being used for the image development is returned to the vessel 12 by rotation of the cylindrical member 11.

The magnet member 13 is in a columnar shape having a plurality of magnet poles (in the illustration, eight magnet poles of $N_1$–$N_4$ and $S_1$–$S_4$) and is coaxially disposed with the cylinder 11 in the hollow interior of the non-magnetic cylinder 11. As illustrated, the magnet poles of mutually opposite polarity are alternately arranged around the magnet member 13 at an equal interval, as shown in the drawing. As to intensity of each magnet pole, $N_1$ is stronger than $S_1$, and $S_1$ is stronger than $N_2$ ($N_1 > S_1 > N_2$) according to the illustrated embodiment, all the remaining poles having mutually equal intensity. For example, the intensity of the remaining pole may be made equal to the intensity of the $S_1$ pole.

The magnet member 13 is fixed on a shaft 15 which is rotatably held (but not rotatable during the developing process) with respect to the main body of the developing apparatus. A circular disc 16 is fixed on this shaft 15, and a spring hole 17 is perforated in this disc 16. A click spring 18 is fitted in the spring hole 17 to energize a click ball 20 in the outward direction. The click ball 20 is so constructed that it may be fitted in the disc 16 in a relatively, freely slidable and rotatable manner, and be fitted in a click hole 21 formed in a ring 19, thereby positioning the rotating position of the magnet member 13. In the illustrated embodiment, the click hole 21 is formed in the ring 19 spaced apart by 45 degrees with respect to the shaft 15. The click ball 20 is also constructed in such a manner that, when it is fitted in the uppermost hole 21 in the drawing, the magnet pole $N_1$ may be on the line component joining the shaft 15 and the rotational center of the drum 1; that when the ball fits in the center hole, the magnet pole $S_1$ may be on the line component; and that when the ball fits in the bottommost hole 21, the magnet pole $N_2$ may be on the line component. In other words, by rotating the shaft 15, each of the magnet poles $N_1$, $S_1$ and $N_2$ in the magnet member 13 can be selectively positioned at one and same position (in this case, at a position where a magnetic field in the same direction (including a magnetic field perpendicular to the cylinder 11 and the photosensitive member 4 in the embodiment) is formed), whereby each of the magnet poles can be stopped at the position during the developing process, and the magnetic flux density at the developing section can be varied. Needless to say, magnitude of the magnetic flux density at the developing section becomes maximum when the magnet pole $N_1$ is disposed at the abovementioned position, becomes minimum when the magnet pole $N_2$ is disposed at the above-mentioned position, and becomes an intermediate magnitude between the abovementioned maximum and minimum values when the magnet pole $S_1$ is on that position. The shaft 15 is rotated by manipulating a dial which is integrally fixed on this shaft 15 and disposed outside the casing of the reproduction apparatus by an operator in accordance with a condition of image original for reproduction.

Incidentally, even when the magnet member 13 is selectively positioned at the abovementioned three rotating and stopping positions, any one of the magnet poles $S_2$, $N_4$ and $S_4$ is positioned at the same place (a position of $S_3$ in FIG. 2) opposite to the magnetic doctor blade 14 through the cylindrical wall of the cylinder 11. And, since the magnetic force of these three magnet poles are equal, the developer layer thickness to be formed on the peripheral surface of the cylinder 11 and conveyed to the developing section D, i.e., the quantity of the developer, is maintained constant, even if the magnetic flux density of the magnetic field at the developing section D varies. In case the original image has a colored background such as colored paper, etc., or has an abnormally high potential on its overall surface, the magnet member is disposed at the position in FIG. 9, i.e., a position where the magnet pole $N_1$ of the strongest magnetic force forms the magnetic field at the developing section. By this magnetic force, the developed image has a large threshold value for the toner transfer as shown in FIG. 8 with the consequence that the developed image free from the ground fogging is obtained. On the other hand, when the original image is white paper, etc. which makes it primarily difficult to cause the ground fogging, the magnet pole $N_2$ having the weakest magnetic force is disposed at a position of the $N_1$ pole in FIG. 9, whereby a favorable developed image free from the fogging and having satisfactory gradation can be obtained. Further, when the latent image is between the abovementioned two magnetic forces, the magnet pole $S_1$ is disposed at a position of the pole $N_1$ in FIG. 9, whereby a developed image intermediate of the abovementioned two characteristics can be obtained.

In the following, explanations will be given as to the experiments conducted by use of the apparatus shown in FIG. 9. The minimum space gap between the photosensitive member 4 and the cylinder 11 at the developing section is set at 150 microns, and a space gap between the cylinder 11 and the blade 14 is set at 200 microns. The magnetic flux density on the peripheral surface of the cylinder 11 is set at 1,000 gausses for the magnet pole $N_1$, 750 gausses for the magnet pole $S_1$, 500 gausses for the magnet pole $N_2$, and 600 gausses for the remaining poles. The alternating voltage is in a sinusoidal waveform having a frequency of 200 Hz and an amplitude of 400 V, on which a d.c. voltage of 250 V is superposed. The layer of the one-component magnetic developer having an average particle diameter of approximately 10 microns is approximately 100 microns thick at a position immediately after passage of the blade 14. For developing the colored image original, the magnet pole $N_1$ is used, while the magnet pole $N_2$ is used for developing the white image original, as the result of which there can be obtained developed images free from the fogging and having high and favorable image gradation.

EXAMPLE 3

Figure 10:
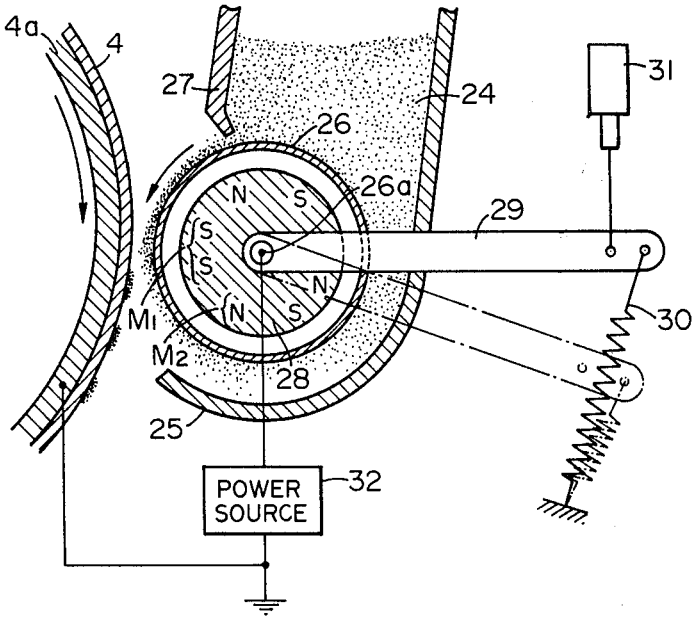
FIG. 10 is also a schematic cross-sectional view of another embodiment of the developing apparatus according to the present invention.

The image development is conducted by moving the surface layer of the developer which is the same as that in the previous examples, in the same direction and at a substantially same speed as the latent image surface at the developing section, and by changing over the repulsive magnetic field and the single magnetic field, whereby developed images of good quality in accordance with kinds of the image original can be obtained. The embodimental construction of the apparatus is as shown in FIG. 10, in which a magnetic field having weak magnetic restraining force is obtained by mutually repulsive magnet poles (in the illustration, the poles S-S of $M_1$). The photosensitive drum 4 includes a photoconductive layer, and is so supported that it may rotate in the arrow direction. Magnetic toner 24 is accommodated in a vessel 25. A numeral 26 refers to a toner carrying member in a cylindrical shape which is made of a magnetic material. The toner carrying member holds thereon the magnetic toner 25 and conveys the same to the developing region. It is so supported as to rotate in an arrow direction. A reference numeral 27 designates a toner applying member to thinly coat the magnetic toner 24 on the toner carrying member 26. This toner carrying member is made of a magnetic material, and serves to cause the magnetic toner to pass through the space gap between the toner applying member and the toner carrying member, while regulating the same in an extremely thin thickness by magnetic force.

A reference numeral 28 designates a magnet having a magnet pole $M_1$ consisting of mutually repulsive magnet poles (S-S) as the developing pole and a single magnet pole $M_2$ in different polarity (N) from that of the magnet pole $M_1$. A numeral 29 refers to an insulative arm to cause the magnet to rotate. The arm pivotally holds, at one end thereof, the magnet, and, at the other end thereof, a plunger 31 which operates against force of a spring 30.

In order to obtain a developed image of a thin line image original, the plunger 31 is actuated to cause the magnet pole $M_1$ to oppose to the developing region, and the magnet 28 is fixed by the arm 29. Also, in order to obtain reproduction of photographs, etc., the plunger 31 is released, the arm 29 is fixed at a dot-and-dash line position by the spring 30, and the development is done by the magnet pole $M_2$. A reference numeral 32 designates an a.c. power source, on which a d.c. voltage is superposed. The power source is connected to a rotational shaft **26*a* of the sleeve 26, and the above-mentioned a.c. bias is applied across the latent image holding member 4 and the sleeve 26** at the developing region.

Figure 11:
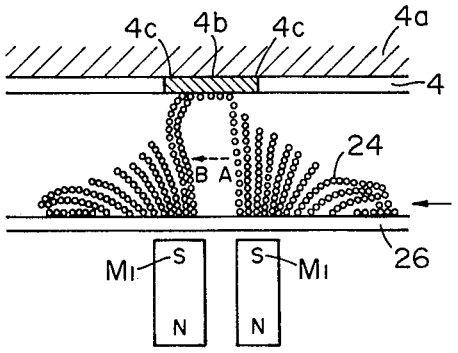
FIG. 11 is an explanatory diagram to explain the function of the repulsive magnetic field in the embodimental apparatus shown in FIG. 10.

When the repulsive pole shown in the drawing is disposed at the developing section, the magnetic fields of each repulsive poles mutually drives back between the magnet poles of the repulsive magnet pole $M_1$ with the consequence that the magnetic restraining force to the toner carrying member 26 becomes weak, and the end portion of the developed image shows good image quality. In the following, this function will be explained in reference to FIG. 11.

FIGS. 2A, 2B and 2C indicate a mode of the toner layer formation along the magnetic line of force at the developing section when the repulsive magnetic field is formed there.

In the region where the repulsive magnetic field is formed as shown, the chains of toner particles 24 arranged in the shape of ears along the magnetic line of force are in a state of being stretched out, and move from the position A to the position B along with movement of the toner carrying member 26 in a state of being stretched out in the direction of the image portion **4*b* of the latent image holding member 4 with movement of the developing sleeve. Accordingly, the toner density in this A-B region is coarse, and adhesive force among the particles as well as between the particles and the developing sleeve is weak, hence transfer of the toner to the latent image holding member 4 can be readily effected. Further, since the toner chains are stretched out, it is also sensitive to electric line of force in the surrounding area of the latent image 4*c***, so that a reproduced image excellent in its thin line reproduction can be obtained. Furthermore, the high speed movement of the toner from the position A to the position B causes a "clouding condition" of the toner at the developing region, whereby the toner transfer takes place at the end part of the latent image due to the edging effect of the latent image.

On the other hand, however, in view of the toner density being low, there takes place such a situation that no dense image can be obtained. Also, there exist such a problem that stretching-up of the toner chains is remarkable, and the tip end of the chains readily contacts the surface of the latent image formation with the consequent tendency to strain the non-image portion due to the fogging phenomenon. It has been found that the abovementioned defect can be improved and a high quality image rich in reproducibility of thin lines and image gradation, and having high image density, when an alternating electric field is applied across the rear surface electrode 4a and the developing sleeve 26 as the toner carrying member. The effect of the alternating electric field under the action of the repulsive magnetic field $M_1$ is assumed to be as follows.

The alternating electric field causes reciprocating motion of the toner particles between the developing sleeve and the latent image forming surface during its passage through the developing section, whereby the toner which has once been transferred to the latent image surface in the form of chains is segregated in the course of its reciprocating motion between the sleeve and the latent image forming surface to be re-oriented uniformly on the image surface. It is also possible that the toner on the broad region on the sleeve be caused to contribute to the development by the effect of the electric field, whereby a high density image can be obtained. It is also possible that the undesirable fogging phenomenon to occur at the non-image portion due to friction of the toner chains be eliminated by the alternating electric field in its opposite phase.

Although, when the repulsive magnetic field is used, the effect of improving the image gradation due to the alternating electric field becomes lower than in the case of the vertical magnetic field created by disposing the single magnet pole in the developing region, the edging effect increases on the other hand. This is considered due to the toner performing the reciprocating motion due to the alternating electric field, disturbed by repulsive magnetic field to be brought into the clouded state, and attracted to the surrounding region of the image due to the edging effect.

In the following, other embodiment of the present invention will be explained in reference to FIG. 10.

The developing sleeve 26 is of non-magnetic stainless steel having 30 mm in diameter. The sleeve rotates at its peripheral speed of approximately 100 mm/sec. so as to eliminate a difference in speed with the surface of the latent image holding member.

The magnet pole $M_1$ in the magnet 28 consists of the repulsive poles (S-S) having the magnetic flux density of 850 gausses and 850 gausses, respectively, while the magnet pole $M_2$ is a single pole having the magnetic flux density of 650 gausses.

The magnetic toner 24 consists of 60 wt.% of polystyrene, 35 wt.% of magnetite, and 5 wt.% of charge controlling agent, to which 0.2 wt.% of colloidal silica is added for improvement in its fluidity.

The magnetic blade 27 is made of iron, and fixedly positioned by a well known means, maintaining a space gap between the blade and the sleeve at 200 microns, and a space gap between the sleeve and the drum at 300 microns.

The latent image has a potential of +500 V at the dark portion, and zero volt at the bright portion. The developing bias used is an alternating current of Vpp 900 V, on which a direct current of +200 V is superposed.

Using these elements, when the repulsive magnet pole $M_1$ is selected to bring the same to the developing position, the toner particles assumes the clouded state in conjunction with the alternating electric field, whereby high quality thin line image is reproduced due to the edging effect. Also, when the single pole $M_2$ is selected to bring the same to the developing position, there is formed an ordinary magnetic brush. As the result, the reciprocating motion of the developing toner particles in the space gap at the developing section is enhanced much more in conjunction with the alternating electric field to produce the developed image almost free from the ground fogging.

It should lastly be noted that the present invention is not limited only to the afore-described embodiments, but various changes and modifications may be made within the spirit and scope thereof as set forth in the appended claims.

What we claim is:

1. A method for development, which comprises:

(a) oppositely arranging a moving latent image holding member and a developer carrying member having a non-conductive magnetic developer coated on the surface thereof, said image holding member and said developer carrying member being mutually spaced apart at an image developing section by an amount greater than the thickness of a layer of the developer coated on the surface of said developer carrying member;

(b) causing the spaced-apart, non-conductive developer to perform reciprocating motion between an image portion and a non-image portion of said latent image holding member and said developer carrying member at least in the region of closest approach between the latent image holding member and the developer carrying member in response to application of an alternating electric field across said latent image holding member and said developer carrying member; and (c) moving the surface of the developer layer carried on said developer carrying member at the developing section in substantially the same direction and at substantially the same speed as the latent image holding member.

2. The method as set forth in claim 1, wherein the following relationship is satisfied:

$$0.3 \times Vp \leqq f$$

where Vp denotes a peripheral speed (mm/sec.) of said latent image holding member, and f represents a frequency (Hz) of said alternating electric field.

3. The method as set forth in claim 1, wherein said developer carrying member is moved slower by 2 to 6% than the moving speed of said latent image holding member, thereby substantially equalizing the moving speed of the developer surface layer carried by said developer carrying member with that of said latent image holding member.

4. The developing method according to claim 3, wherein said alternate voltage satisfies the following relations when the image area charge is positive, $$V_{min} \approx V_L - |Vth \cdot f|$$

and when the image area charge is negative, $$V_{max} \approx V_L + |Vth \cdot f|$$

where Vth·f represents the potential difference threshold value at which said developer is separated from the surface of said non-magnetic conductive member to transit to said latent image bearing surface.

5. The developing method according to claim 3, wherein said alternate voltage satisfies the following relations when the image area charge is positive, $$V_{max} \approx V_D + |Vth \cdot r|$$

and when the image area charge is negative, $$V_{min} \approx V_D - |Vth \cdot r|$$

where Vth·r is the potential difference threshold value at which said developer is separated from said latent image bearing surface to transmit to said non-magnetic conductive member.

6. The developing method according to claim 1 or 2, wherein said alternate electric field satisfies the following relations when the image area charge is positive $$|V_{max} - V_L| > |V_L - V_{min}|$$

$$|V_{max} - V_D| < |V_D - V_{min}|$$

and when the image area charge is negative $$|V_{min} - V_L| > |V_L - V_{max}|$$

$$|V_{min} - V_D| < |V_D - V_{max}|$$

where $V_{max}$ represents the maximum value of the alternate electric voltage of said non-magnetic conductive member with the back electrode of said latent image bearing member as the standard, $V_{min}$ represents the minimum value of said voltage, $V_D$ represents the image area potential, and $V_L$ represents the non-image area potential.

7. A method for development which comprises:

(a) oppositely arranging a developer carrying member, incorporating therewithin a magnet and carrying a particulate, non-conductive magnetic developer layer on the surface thereof, and a latent image holding member spaced apart mutually at an image developing section with a predetermined space gap therebetween;

(b) moving the developer surface layer carried on said developer carrying member at said image developing section in substantially the same direction and at substantially the same speed as those of the latent image holding member;

(c) causing the spaced apart, non-conductive developer particles to perform reciprocating motion in response to application of an alternating electric field to said space gap for the image development; and (d) selectively changing, at said image developing section, magnetic poles forming different magnetic fields so as to provide different developing magnetic poles.

8. An image developing method, wherein a developer carrying member is oppositely arranged against a latent image holding member at an image developing section with a small space gap therebetween, said method comprising:

(a) applying an alternating bias to said space gap;

(b) moving a developer surface layer carried on said developer carrying member at the image developing section in substantially the same direction and at substantially the same speed as those of the latent image holding member; and (c) effecting the image development by selectively forming, at said image developing section, a repulsive magnetic field with repulsive magnet poles and a magnetic field of polarity different from said repulsive magnetic field with a single magnet pole by selectively moving said repulsive magnetic poles and said single magnetic pole into the region of said image developing station.

9. A method for development, which comprises:

(a) oppositely arranging a moving latent image holding member and a developer carrying member having a non-conductive magnetic developer coated on the surface thereof, said image holding member and said developer carrying member being mutually spaced apart at an image developing section by an amount greater than the thickness of a layer of a developer coated on the surface of said developer carrying member, wherein said developer carrying member is a non-magnetic cylinder with a magnet therein;

(b) causing the spaced-apart, non-conductive magnetic developer to perform reciprocating motion between an image portion and a non-image portion of said latent image holding member and said developer carrying member at least at the region of closest approach between the latent image holding member and the developer carrying member in response to application of an alternating electric field across said latent image holding member and said developer carrying member; and (c) moving the surface of the developer layer carried on said developer carrying member at the developing section in substantially the same direction and at substantially the same speed as the latent image holding member.

* * * * *

UNITED STATES PATENT AND TRADEMARK OFFICE

CERTIFICATE OF CORRECTION

PATENT NO. : 4,425,373

DATED : January 10, 1984

INVENTOR(S) : NAGAO HOSONO, ET AL.

It is certified that error appears in the above-identified patent and that said Letters Patent is hereby corrected as shown below:

Column 1, line 49, after "2,862,816" insert --;--.

Column 5, line 67, "is" should read --has--.

Column 7, line 65, "treshold" should read --threshold--.

Column 8, line 13, "havng" should read --having--.

Column 9, line 31, after "which" insert --there is--;
line 33, after "powder." insert --)--;
line 49, "5e" should read --5c--;
line 66, "2" should read --5--.

Column 11, line 2, "portin" should read --portion--.

Column 13, line 30, "sufficiency" should read --sufficiently--.

Column 15, line 23, "mainimum" should read --minimum--.

Column 19, line 39, "other" should read --another--;
line 67, "assumes" should read --assume--.

UNITED STATES PATENT AND TRADEMARK OFFICE

CERTIFICATE OF CORRECTION

PATENT NO. : 4,425,373

DATED : January 10, 1984

INVENTOR(S) : NAGAO HOSONO, ET AL.

It is certified that error appears in the above-identified patent and that said Letters Patent is hereby corrected as shown below:

Column 21, Claim 5, line 21, "transmit" should read --transit--.

Signed and Sealed this

*Twenty-eighth* Day of *August 1984*

[SEAL]

*Attest:*

GERALD J. MOSSINGHOFF

*Attesting Officer*

*Commissioner of Patents and Trademarks*